US008033067B2

(12) United States Patent
Miller

(10) Patent No.: US 8,033,067 B2
(45) Date of Patent: Oct. 11, 2011

(54) MULTI-LEVEL APARTMENT BUILDING

(76) Inventor: Allan S. Miller, Jackson Heights, NY (US)

( * ) Notice: Subject to any disclaimer, the term of this patent is extended or adjusted under 35 U.S.C. 154(b) by 219 days.

(21) Appl. No.: 12/476,234

(22) Filed: Jun. 1, 2009

(65) Prior Publication Data

US 2009/0293384 A1 Dec. 3, 2009

Related U.S. Application Data

(63) Continuation-in-part of application No. 10/948,025, filed on Sep. 23, 2004, now Pat. No. 7,540,120.

(60) Provisional application No. 60/505,401, filed on Sep. 23, 2003.

(51) Int. Cl.
*E04H 1/00* (2006.01)

(52) U.S. Cl. ..... 52/236.3; 52/236.7; 52/79.2

(58) Field of Classification Search ..... 52/79.1, 52/236.3, 236.4, 236.6, 236.7, 236.9, 264
See application file for complete search history.

(56) References Cited

U.S. PATENT DOCUMENTS

| | | | | |
|---|---|---|---|---|
| 3,503,170 | A | 3/1970 | Shelley | |
| 3,513,607 | A | 5/1970 | Renes | |
| 3,564,795 | A | 2/1971 | Henton | |
| 3,605,354 | A | 9/1971 | Hodgetts | |
| 3,656,266 | A | 4/1972 | Tylius | |
| 3,694,973 | A | 10/1972 | Unger | |
| 3,716,954 | A | 2/1973 | Kelbish | |
| 3,724,143 | A | 4/1973 | Paukulis | |
| 3,742,666 | A | 7/1973 | Antoniou | |
| 3,750,354 | A | 8/1973 | Boros | |
| 3,805,461 | A | 4/1974 | Jagoda | |
| 3,831,327 | A | 8/1974 | McCrillis et al. | |
| 3,884,001 | A | 5/1975 | Tylius | |
| 4,098,039 | A | 7/1978 | Sutelan | |
| 4,120,133 | A | 10/1978 | Rodgers et al. | |
| 4,211,043 | A | 7/1980 | Coday | |
| 4,248,020 | A | 2/1981 | Zielinski et al. | |
| 4,596,097 | A | 6/1986 | Stewart et al. | |
| 4,794,747 | A * | 1/1989 | Yendo | 52/236.3 |
| 4,919,164 | A | 4/1990 | Barenburg | |
| 4,928,452 | A | 5/1990 | Sacks | |
| 4,930,273 | A | 6/1990 | Papesch | |

(Continued)

OTHER PUBLICATIONS

The Steinberg Collaborative, AIA, LLP Architects and Planners (1999).

*Primary Examiner* — Eileen Lillis
*Assistant Examiner* — Brandon C Painter
(74) *Attorney, Agent, or Firm* — Brian Roffe

(57) ABSTRACT

A system of spaces including a residential apartment unit in a multi-unit building arranged on multiple levels that provides the following attributes to all units in the building: Central corridor access to a middle level of each unit; through-unit feature with exposures at opposite sides of the building; a variety of ceiling heights, each appropriate to the function and formality of its respective space, which nest to conserve building height and bulk; and internal balconies and exposed interior stairs enabling vertically displaced spaces to interlock and communicate visually. The resulting unit is contained within a demising envelope whose shape, when rotated 180 degrees about a central public corridor serving a second such unit, forms a complimentary pair. The combined shape of each such pair of units enables it to be stacked vertically and abutted laterally into a simple rectangular solid that allows vertical continuity for optimum efficiency of structural and mechanical support systems.

17 Claims, 19 Drawing Sheets

U.S. PATENT DOCUMENTS

| | | | |
|---|---|---|---|
| 5,076,310 | A | 12/1991 | Barenburg |
| 5,528,866 | A | 6/1996 | Yulkowski |
| 5,694,725 | A | 12/1997 | Kaufman et al. |
| 5,809,704 | A | 9/1998 | Stewart et al. |
| 5,941,034 | A | 8/1999 | Frankfurt |
| 6,393,774 | B1 | 5/2002 | Fisher |
| 6,574,931 | B2 | 6/2003 | Duany |
| 6,578,330 | B1 | 6/2003 | Bergman |
| 6,625,937 | B1 | 9/2003 | Parker et al. |
| 6,651,393 | B2 | 11/2003 | Don et al. |
| 6,688,055 | B2 | 2/2004 | Lindsley |
| 6,698,147 | B2 | 3/2004 | Bergman |
| 6,922,960 | B2 | 8/2005 | Sataka |
| 7,540,120 | B2 * | 6/2009 | Miller ..... 52/236.3 |
| 2003/0150178 | A1 * | 8/2003 | Bergman ..... 52/234 |
| 2006/0153358 | A1 * | 7/2006 | Zernovizky et al. ..... 379/392.01 |

* cited by examiner 11
5A
5B 4A
4B
4C
BR 2
10B
BR 3
MBR
+15R
+19R
UP
DN
D
10A
K / DR
A
B
34
25
29
C
-18R
-14R
+ 0.0
- 4R
L Longitudinal Section 5A View of furnished Module B from landing 32L toward a fenestrated façade and exterior balcony in a preferred embodiment View of furnished Module B from interior balcony 69 toward a fenestrated façade and exterior balcony in a preferred embodiment View of a partly furnished Module B from level 38 toward module D in a preferred embodiment, including views into Modules B and C -15R
A
- 4R
+0.0
+6R
+16R
C
K / DR
BR
L
MBR
BR 3
BR 2
UP
DN
+ 20R
B
+16 R
D
10A
+ 20 R
+ 0.0
A
B
25
- 4 R
-4R
-19 R
-15 R
-19R

C LONG. SECTION

PLAN
+6R

VARIES
CROSS SECTION

- 4R
+0.0
+7R
+16R
K / DR
BR
L
MBR
BR 3
BR 2
UP
DN
+16 R
+20 R
+ 0.0
-4 R
-19 R
-15 R
+ 20R
+ 16R
-4R
-15R
-19R
D
10A
B
25
C

LONG. SECTION
PLAN

VARIES
CROSS SECTION

A
- 4R
+0.0
+8R
+16R
C
K / DR
BR
L
MBR
BR 3
BR 2
UP
DN
+ 16 R
+ 20 R
+ 0.0
- 4 R
-19 R
-15 R
+ 20R
+16R
4R
+0.0
-15R
-19R
B
D
10A
A
B
25
C

LONG. SECTION
PLAN

+8R

VARIES
CROSS SECTION

MULTI-LEVEL APARTMENT BUILDING

CROSS REFERENCE TO RELATED APPLICATIONS

This application is a continuation-in-part of U.S. patent application Ser. No. 10/948,025 filed Sep. 23, 2004, now U.S. Pat. No. 7,540,120, which claims the benefit of U.S. Provisional Patent Application Ser. No. 60/505,401 filed Sep. 23, 2003, both of which are incorporated by reference herein.

FIELD OF THE INVENTION

The invention generally relates to a 'luxury' class of residential apartment structures which emulate the features of detached dwellings. When applied to vertically superimposed apartment units found in high-rise developments, the combination of features offered by the present invention is usually limited to penthouse locations, which are customarily less constrained in height and footprint. The present design makes penthouse features available to all floors of such structures, without sacrificing the energy efficiency inherent in a simplified building envelope, or the economy and constructability of a conventional high-rise structural system. Efficient fabrication is inherent in the economy of scale of such structures, and energy efficiency is inherent in their low surface-to-volume ratio.

BACKGROUND OF THE INVENTION

High-rise development is favored in an increasingly crowded and environmentally challenged world. The higher density afforded by such structures reduces the per capita footprint and consequent impermeable surfaces which cause flooding, pollution of storm water, high albedo effects, and the congestion engendered by sprawling development due to longer travel distances, and consequent fuel consumption, air pollution and other effects of a 'carbon footprint'.

The present invention addresses itself to that mobile class of homeowners whose means and inclinations most commonly result in sprawl. It offers a viable alternative to the private detached dwelling that achieves comparable amenities together with the environmental efficiencies of high-rise development.

Two attributes of the design cannot be claimed as program objectives in efficient apartment planning, but make a positive contribution to a visually complete environment: The stairs permit vantage points that enrich the visual experience, and a modicum of physical rigor that has come to be valued in an increasingly sedentary world. The corridors serve the private zones of the dwelling by imparting a sense of seclusion, and refuge from the boisterous communal functions, as well as providing gallery space for personal expression.

The 'complete visual experience' fulfills a cognitive need inclining humans to three dimensional complexity in the spatial environment. It exercises the faculty of depth perception enabled by stereoscopic vision—a unique adaptive response to the primordial arboreal habitus. This complexity therefore brings into the apartment an element that enables the space to be comfortably occupied for longer periods. It is believed that this is essential to the definition of habitability.

SUMMARY OF THE INVENTION

A residential apartment unit arranged on multiple levels capable of providing the foregoing attributes of a detached dwelling to all units of a building. The apartment unit is contained within a demising envelope whose shape fulfills at least four objectives:

1. Distributing the enclosed volume of a multi-unit apartment building meaningfully by moderating the height of each space within the apartments according to its function and proportionately to its plan dimensions. Within the floor area limits imposed by zoning laws, this distribution of volume enables utilization of an asset that is ordinarily wasted by apartment 'flat' designs with ceilings of conventional height. Such designs typically consume less building volume than the full bulk envelope to which zoning laws entitle them;

2. Nesting of vertically stacked volumes to conserve building height;

3. Horizontal alignment of such stacked units to consolidate and convey vertically continuous services, and accommodate shafts, and chutes; and 4. Complementary pairs of such units form a rectangular footprint that offers a simplified boundary for vertically continuous supporting structure. The units generally extend across a centrally located public corridor to opposite facades of the building. Each public corridor provides access to a row of such apartment pairs only on entry levels, which increases the vertical interval between corridors to over two stories, thus minimizing uninhabitable floor area in the building.

BRIEF DESCRIPTION OF THE DRAWINGS

Essential features are illustrated as preferred embodiments of the invention in the following drawings, in which like reference numbers and letters indicate the same or similar elements.

DETAILED DESCRIPTION OF THE INVENTION

The invention is comprised of an arrangement of spaces in an apartment unit organized on basically four vertically displaced floors. The floors are connected by a stair system that may, in a preferred embodiment, incorporate a support wall containing a utility channel for vertically continuous services.

Figure 1:
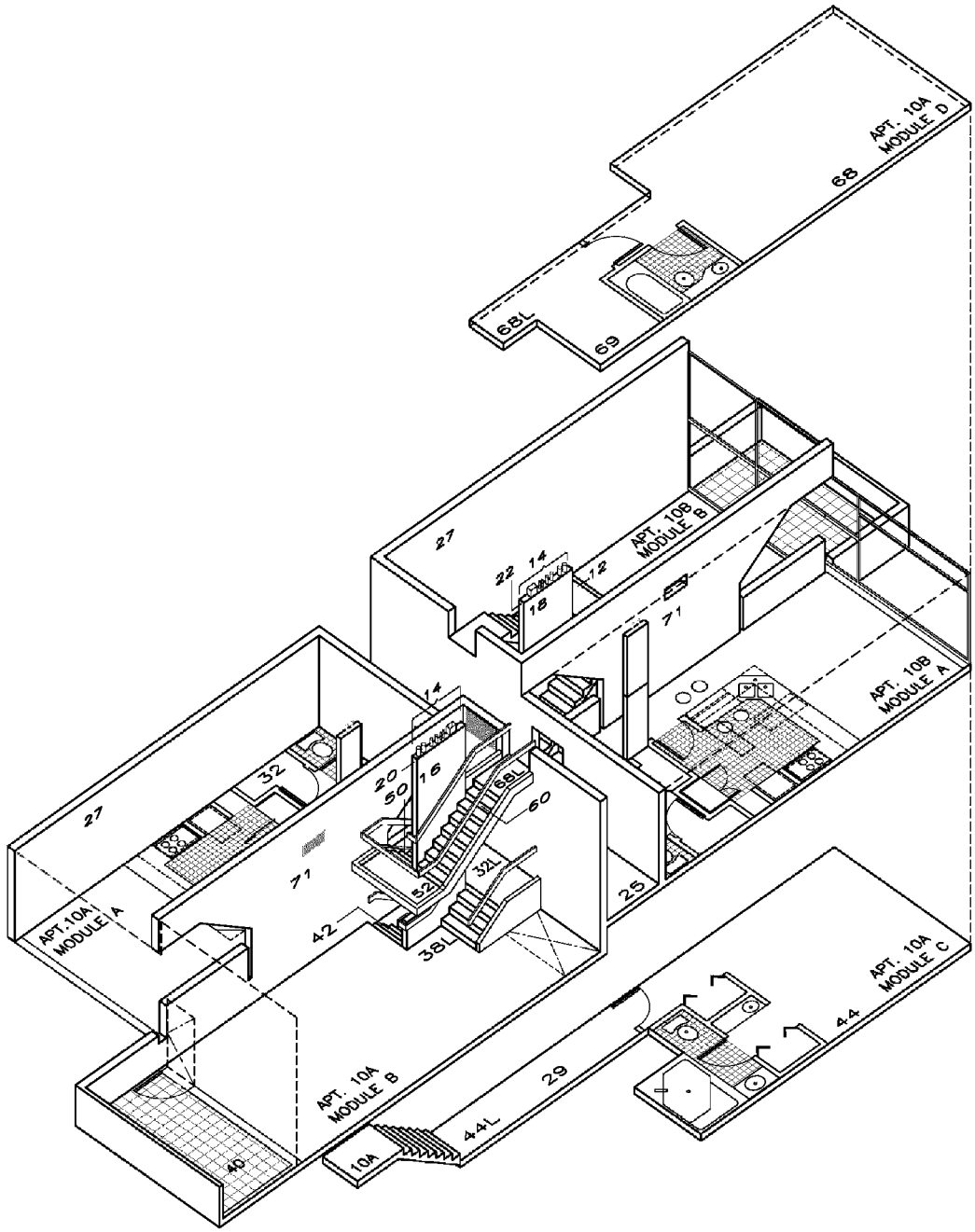
FIG. 1 is an exploded axonometric view of all four levels of a single apartment 10A sharing a public corridor with the second apartment of a pair 10B. The stairs, utility channels, room titles, balconies, partition and fixture layouts are identical in each, as those of a preferred embodiment of the design.
Figure 9:
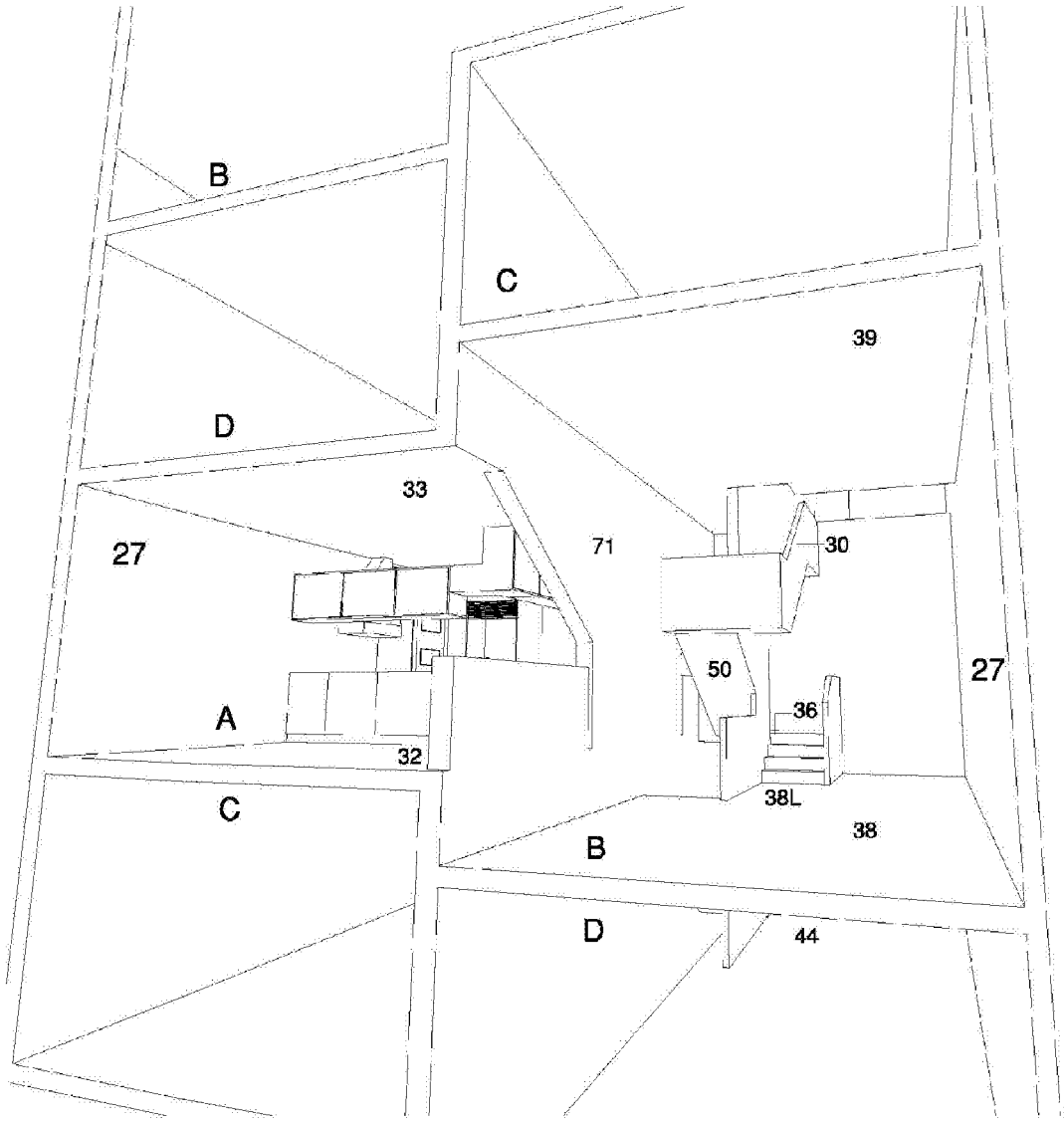
FIG. 9 is a perspective line drawing of a preferred embodiment showing the split-level relationship of Modules A and B in the context of other modules. The exterior balcony is omitted for clarity.
Figure 10:
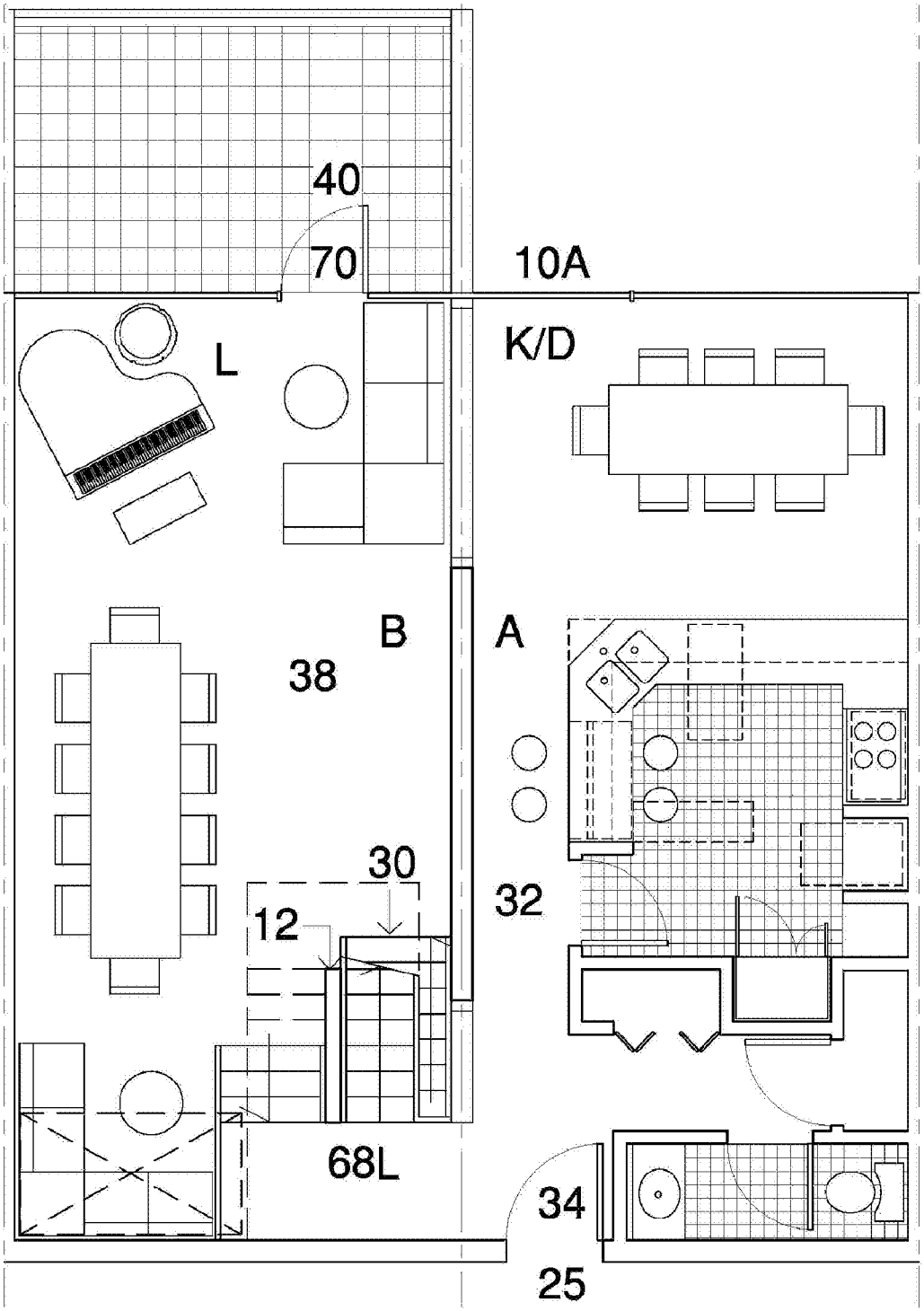
FIG. 10 is an enlargement of FIG. 3B, a furnished partial Floor Plan in a preferred embodiment, showing Modules A and B, with an exterior balcony 40.
Figure 11:
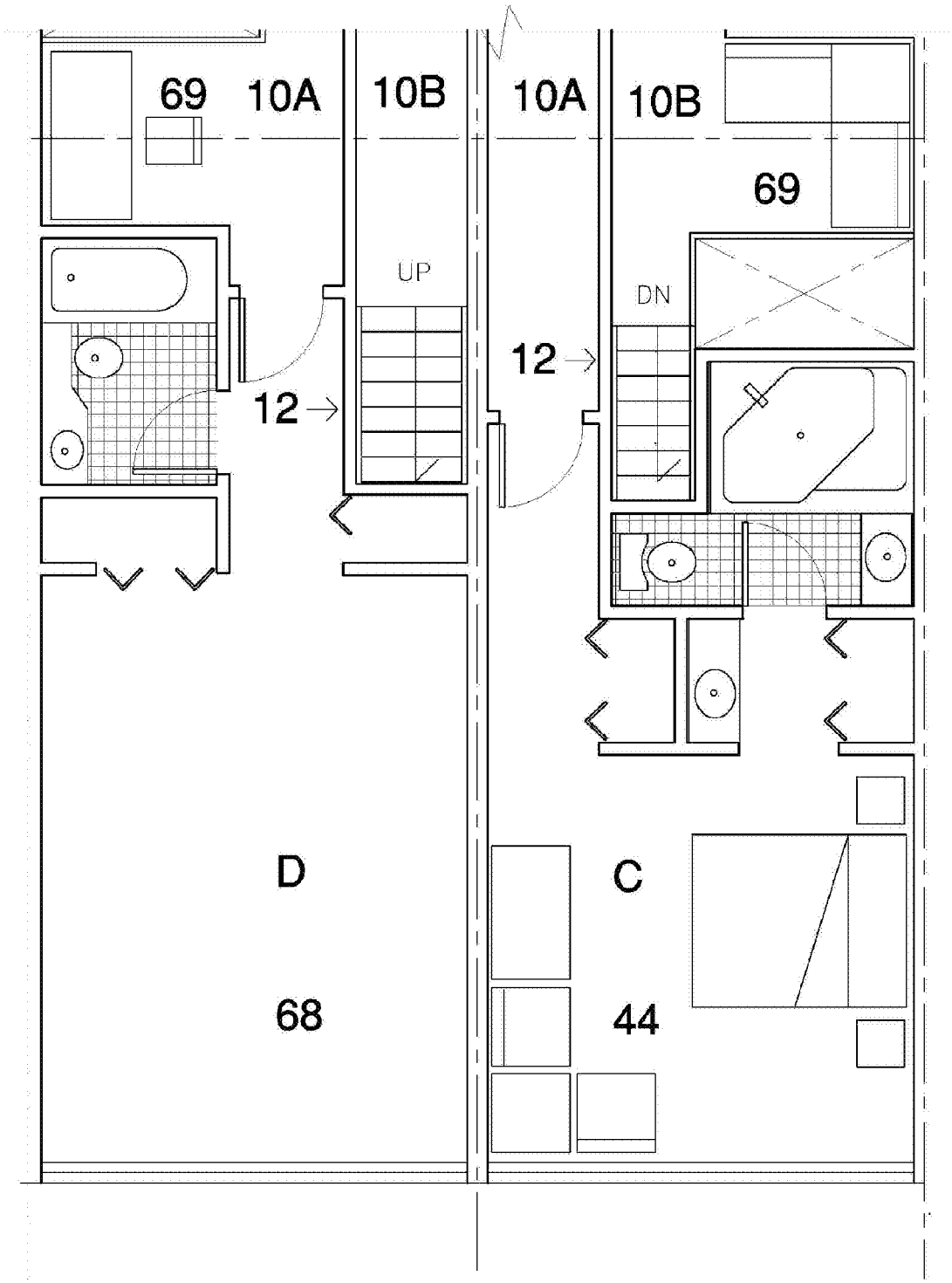
FIG. 11 is an enlargement of FIG. 3C, a furnished partial Floor Plan in a preferred embodiment, showing Modules C and D, with an interior balcony area 69.
Figure 12:
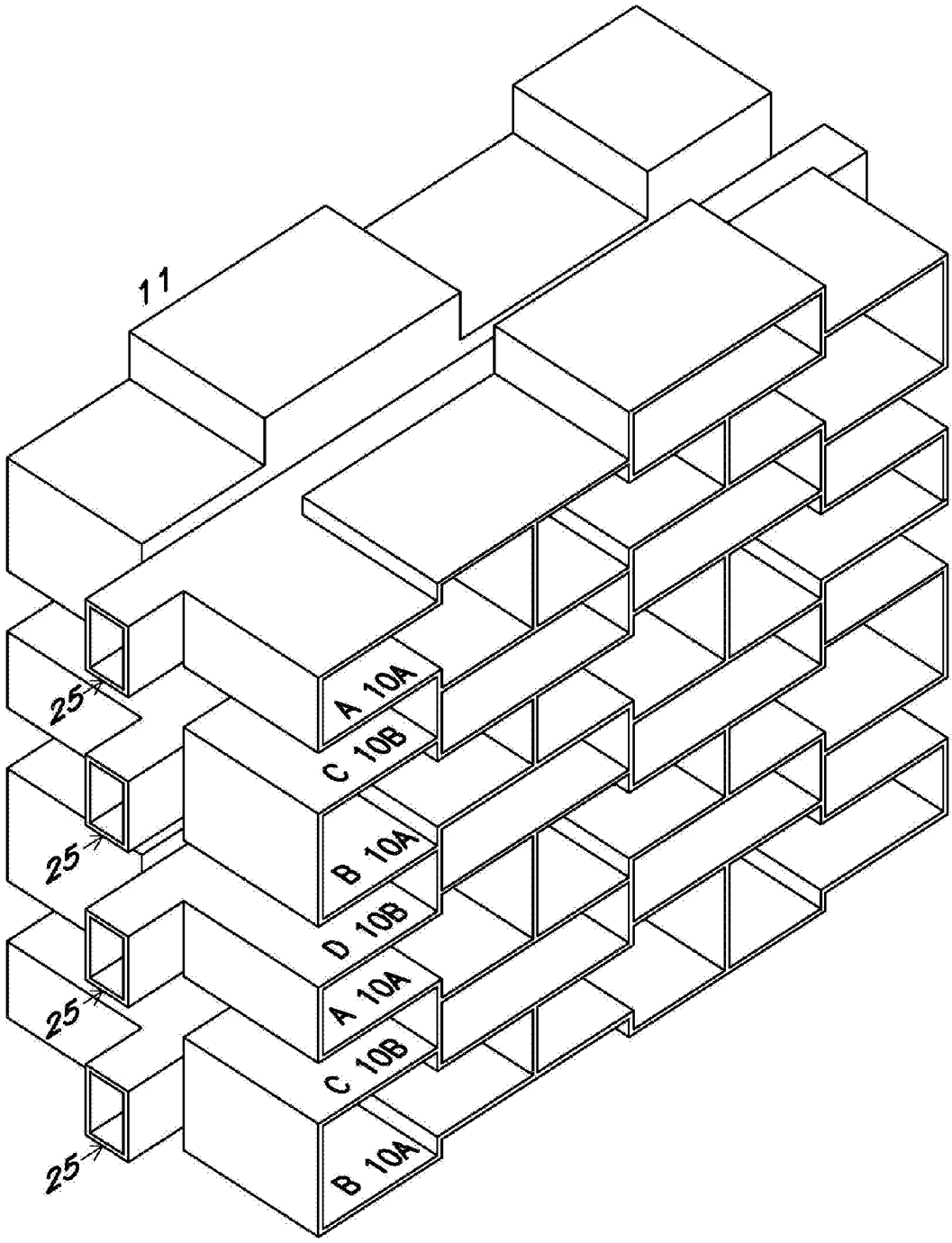
FIG. 12 is an axonometric volume study that demonstrates the geometric relationship between the principal demising elements and the spaces they contain. Portions of certain demising walls and partitions are omitted to clarify the spatial pattern schematically.
Figures 13A, 13B, 13C:
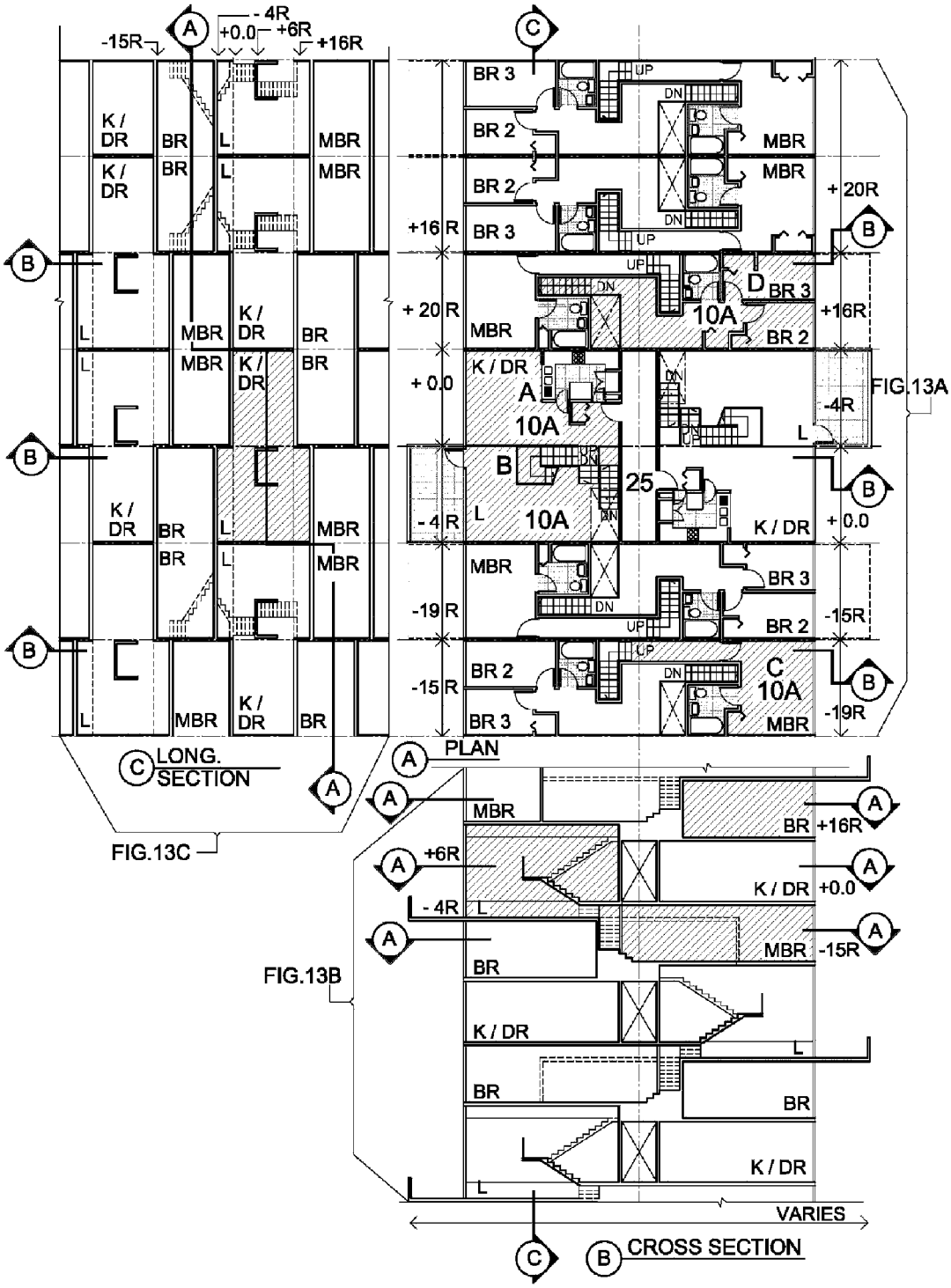
FIG. 13 shows an alternate interior stair arrangement for a typical apartment unit. Its implications are shown by combining a partial Floor Plan 13A, with a Cross-section 13B, and a Longitudinal Section 13C arranged in cabinet drawing format.
Figures 14A, 14B, 14C:
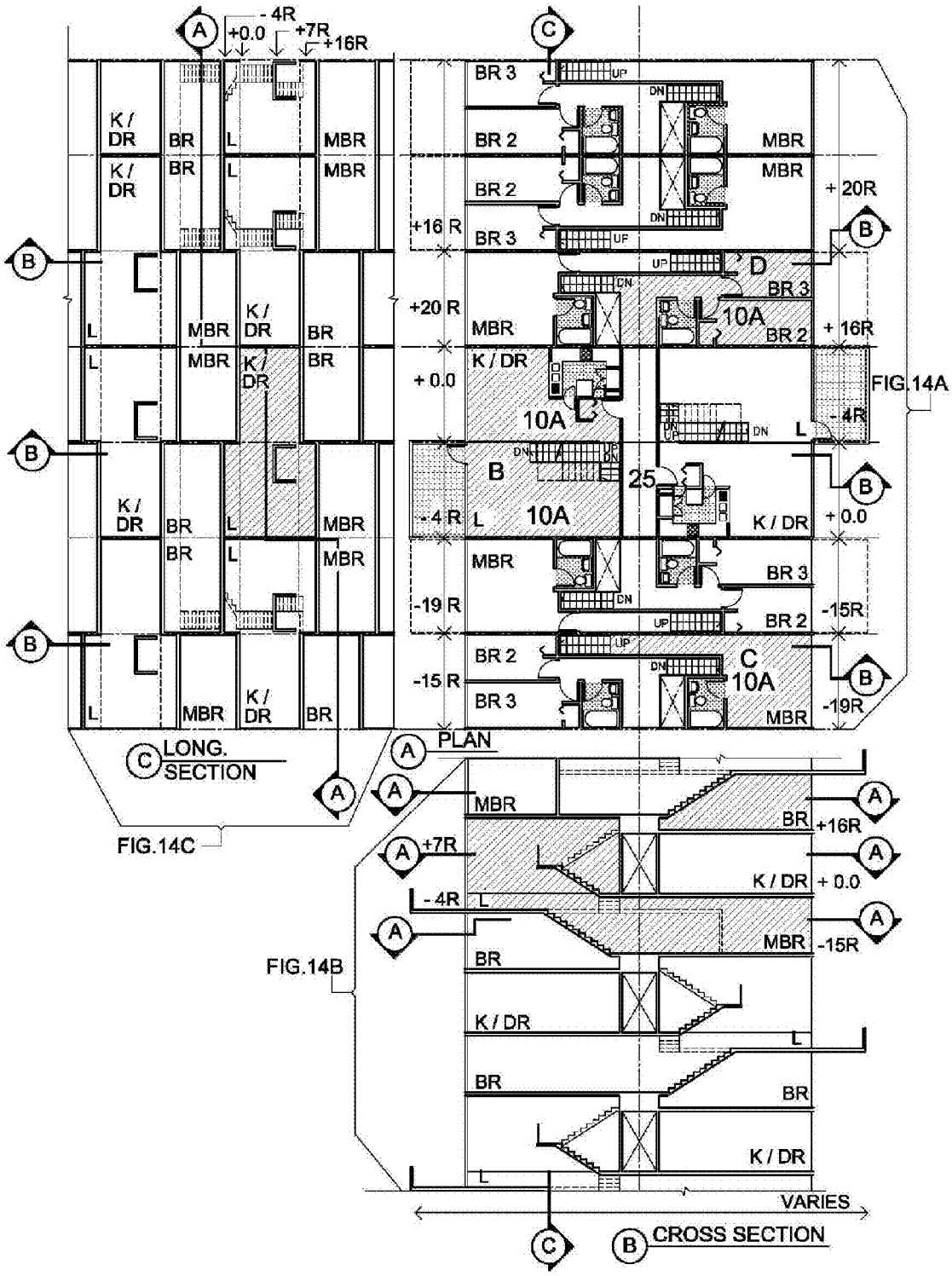
FIG. 14 shows a second alternate interior stair arrangement for a typical apartment unit. Its implications are shown by combining a partial Floor Plan 14A, with a Cross-section 14B, and a Longitudinal Section 14C arranged in cabinet drawing format.
Figures 15A, 15B, 15C:
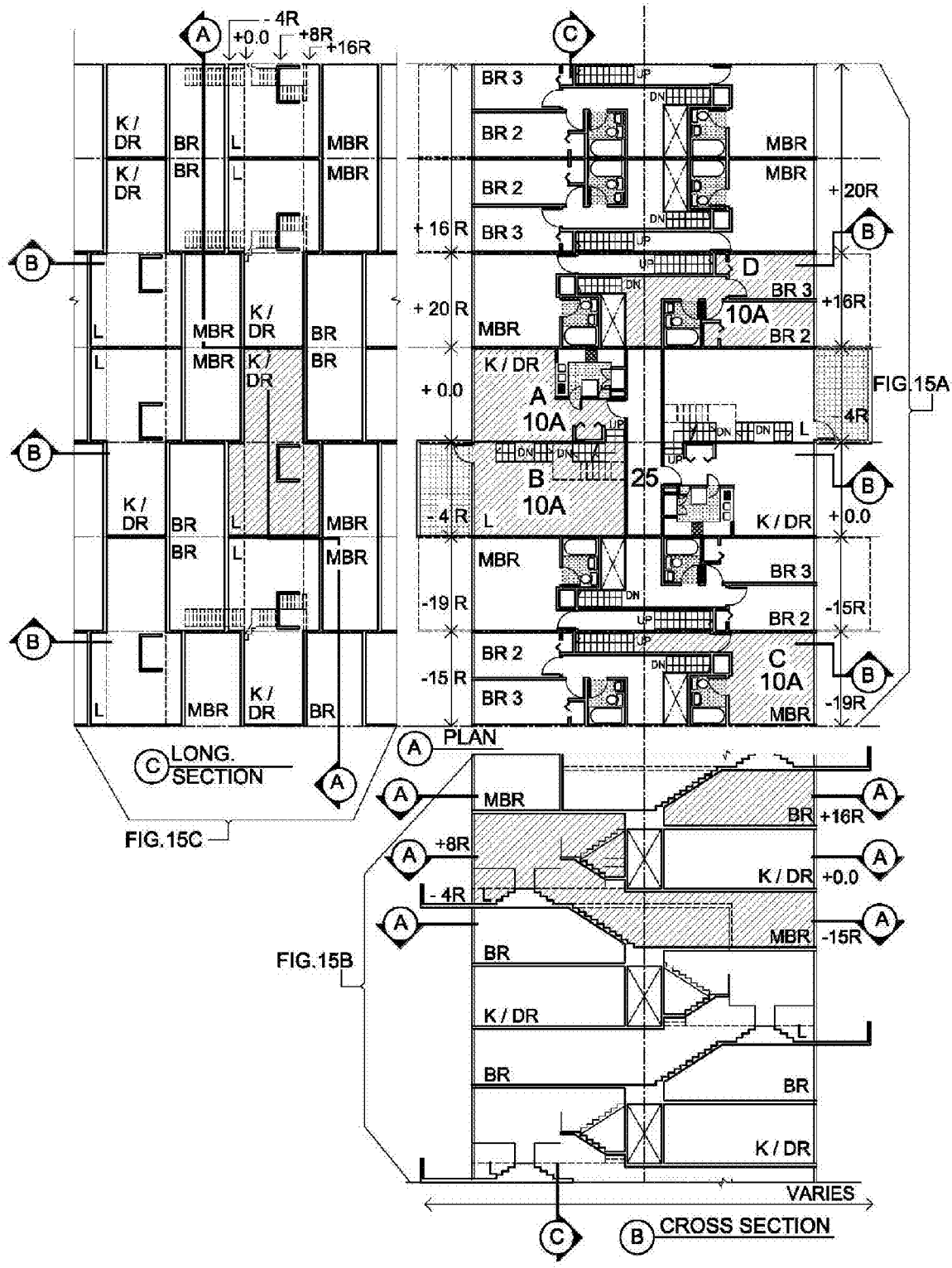
FIG. 15 shows a third alternate interior stair arrangement for a typical apartment unit. Its implications are shown by combining a partial Floor Plan 15A, with a Cross-section 15B, and a Longitudinal Section 15C arranged in cabinet drawing format.

Referring first to FIG. 1, a first apartment unit 10A is entered from a centrally located public corridor 25, nominally coplanar with the first apartment floor level 32 corresponding to Module A. The floor level 32 extends from the apartment entry 34 to the building façade on the same side of the public corridor 25. The ceiling plane of the floor level 32 of Module A is designated 33 (see FIG. 9).

Module A would typically contain the customary functions associated with an entry, including but not limited to a Wardrobe, Utility or Storage Closet, Powder Room, Kitchen, Dining Room. Alternative and/or additional functions may of course be designed without deviating from the scope and spirit of the invention.

The height of Module A and the public corridor 25 is greater than a minimal story height to accommodate an interstitial space for horizontal transfer of utilities within the module and the public corridor 25, above the plane of the finished ceiling. These utilities typically include, but are not limited to, pitched sanitary and condensate drains, air conditioning ductwork, and toilet, dryer and kitchen power exhausts. The additional headroom in the public corridor 25 imparts the formality expected of this function, while the functions within the larger communal spaces of Module A similarly benefit from additional ostensible height in proportion to their greater floor dimensions and desired formality.

Figure 2:
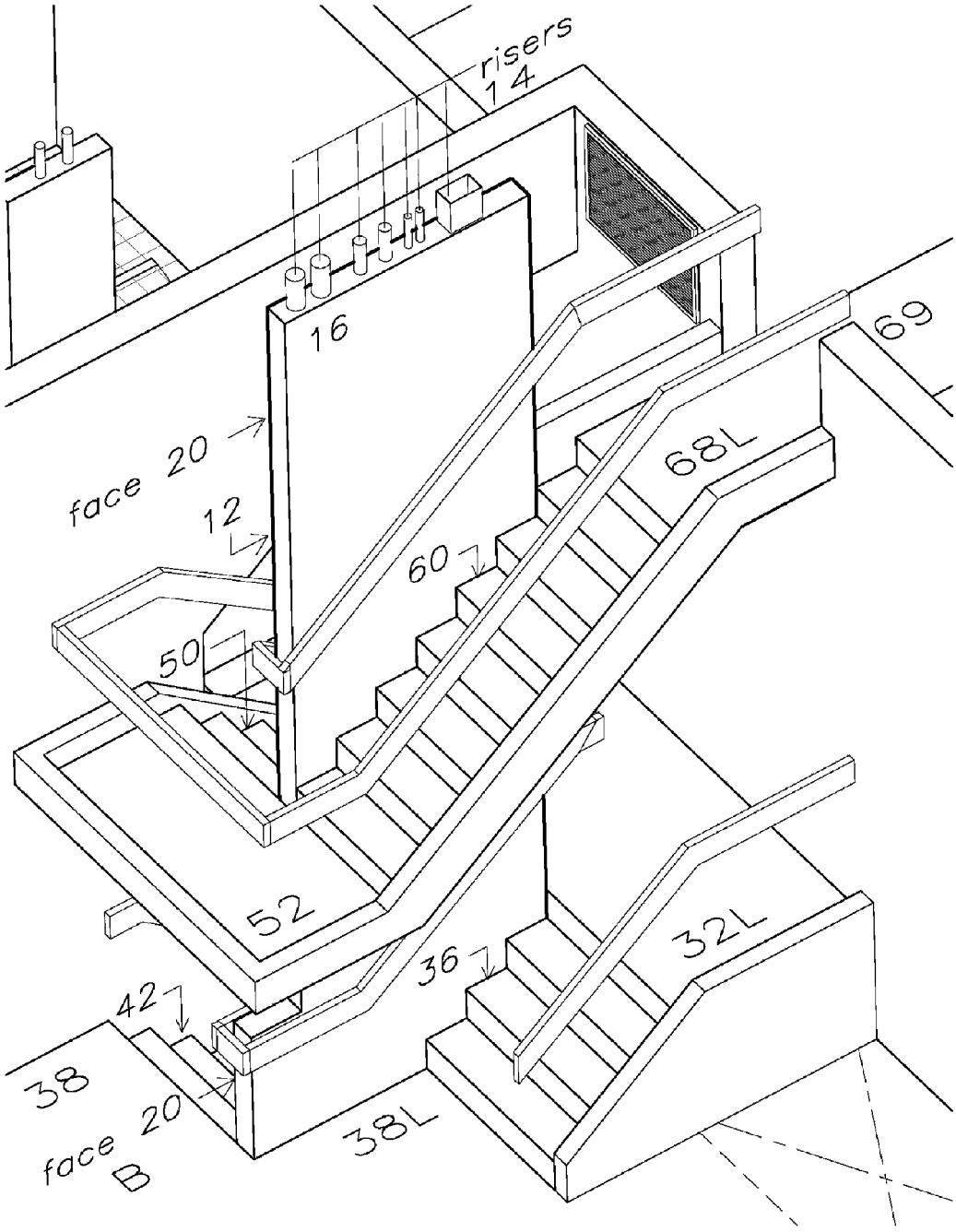
FIG. 2 is an enlarged view of the typical interior stair and support wall with utility channel shown in FIG. 1. The stair is that of a preferred embodiment of the design.

A landing extension of floor level 32 into Module B affords access to the interior stair system leading to upper and lower levels of the apartment. FIG. 2 shows a preferred embodiment of the interior stair system. Descending the steps 36 from floor 32 accesses the floor 38 of Module B a split-level distance, or less than one-half story, below Module A. The floor 38 extends from the public corridor wall to the same building façade as that of landing 32L. The floor 38 includes a landing 38L adjacent to the steps 36.

Module B would typically contain the customary functions of the lower portion of a split-level communal space including but not limited to a Living Room and Den or Study. Alternative and/or additional functions may of course be designed without deviating from the scope and spirit of the invention.

The height of Module B, in a preferred embodiment, is substantially equal to the height of Module A plus approximately twice the difference in elevation between Modules A and B. In addition, as a minimum, sufficient headroom clearance is provided above and beneath a platform 52 of the interior stair to allow passage, where required by the desired stair geometry, and in conformity with applicable building codes (see FIGS. 1 and 2).

Descending steps 42 from the floor 38 in Module B, the floor 44 of Module C is accessed less than a full story below the floor 38 in Module B. The floor 44 extends from the bottom riser of the steps 42, coplanar with an interior corridor 29, beneath the public corridor 25 to the opposite façade of the building from that bounding Modules A and B (see FIG. 1). The floor 44 includes a landing 44L adjacent the steps 42.

Further, the floor 44 is excised to allow headroom clearance required by the upper portion of the interior stair system within Module B of the apartment immediately below. The floor 44, in a preferred embodiment, is further excised to allow clearance for an atrium space within the Module B of the apartment immediately below. The dimensions of interior corridor 29 result from the two foregoing openings in the floor 44.

Module C, in a preferred embodiment, would typically contain the functions of a Master Bedroom suite, including Wardrobe, Master Bath and Bedroom. While its function(s) and dimensions are intimate enough in character to justify a lower ceiling height and privacy from other spaces, its formality relative to those spaces warrants proximity to the Living Room, whose social functions it may share. Alternative and/or additional functions may of course be designed without deviating from the scope and spirit of the invention.

The height of Module C may be the minimum story height. In addition, as a minimum, sufficient headroom clearance is provided beneath the public corridor 25 to allow passage on steps 42 to the interior corridor 29.

Ascending steps 50 from the stair landing at floor level 32, past stair platform 52 and above (see FIG. 2), accesses the floor 68 of Module D above the public corridor 25. The steps 60 lead to a landing 68L of the floor 68. The floor 68 of Module D, including communal area 69 in addition to the landing 68L, extends from the apartment entry wall to the same façade as that bounding Module C.

Module D, in a preferred embodiment, would typically contain the functions associated with one or more minor bedrooms, including Wardrobes, Toilet, and Bedrooms. Alternative and/or additional functions may of course be designed without deviating from the scope and spirit of the invention. A communal area 69 on floor plane 68 falls behind a parapet as an interior balcony overlooking Module B.

Figure 4A:
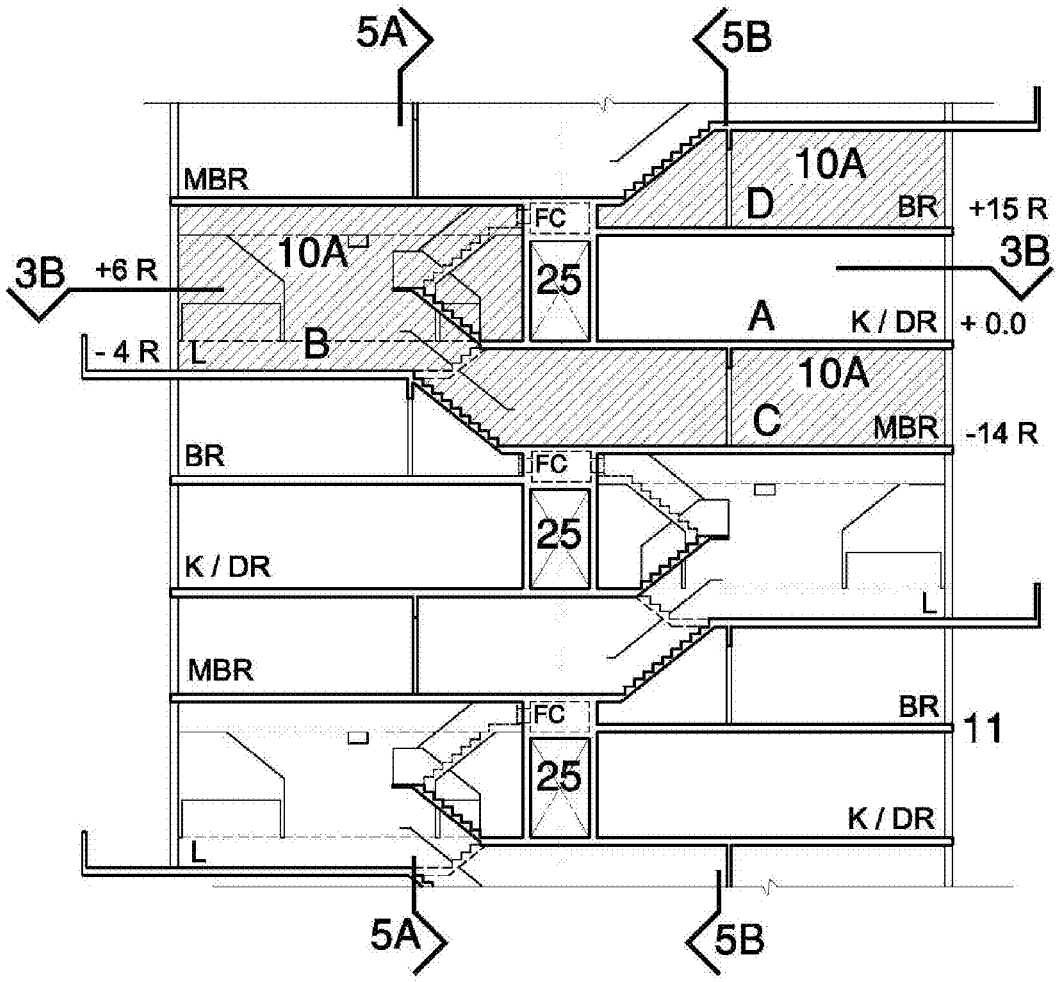
FIGS. 4A, 4B, and 4C are Cross-sections of a preferred embodiment of apartments within a portion of a building taken along Sections 4A, 4B, 4C respectively, shown in FIG. 5. The hatched area distinguishes the extent of a single apartment. A legend designated "R" indicates the number of risers above (+) and below (–) the entry level (0.0) in the interior stair of a preferred embodiment. The extent of these levels in plan is reflected in FIGS. 3A, 3B, 3C, and 3D. "FC" designates a preferred position for a suspended fan coil unit with hydropic connections for temperature control of the major communal spaces within the apartment, served by ducts.
Figure 4B:
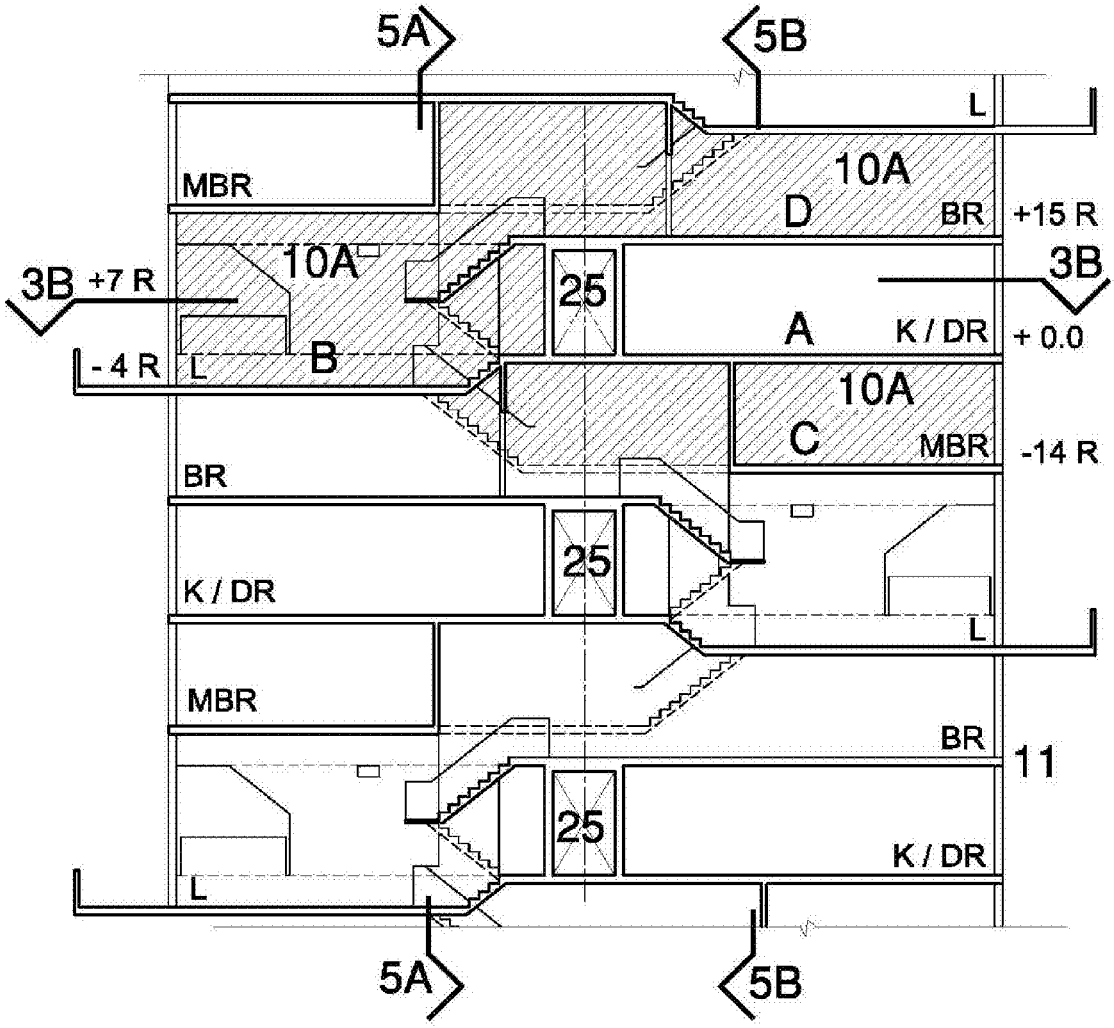
Figure 4C:
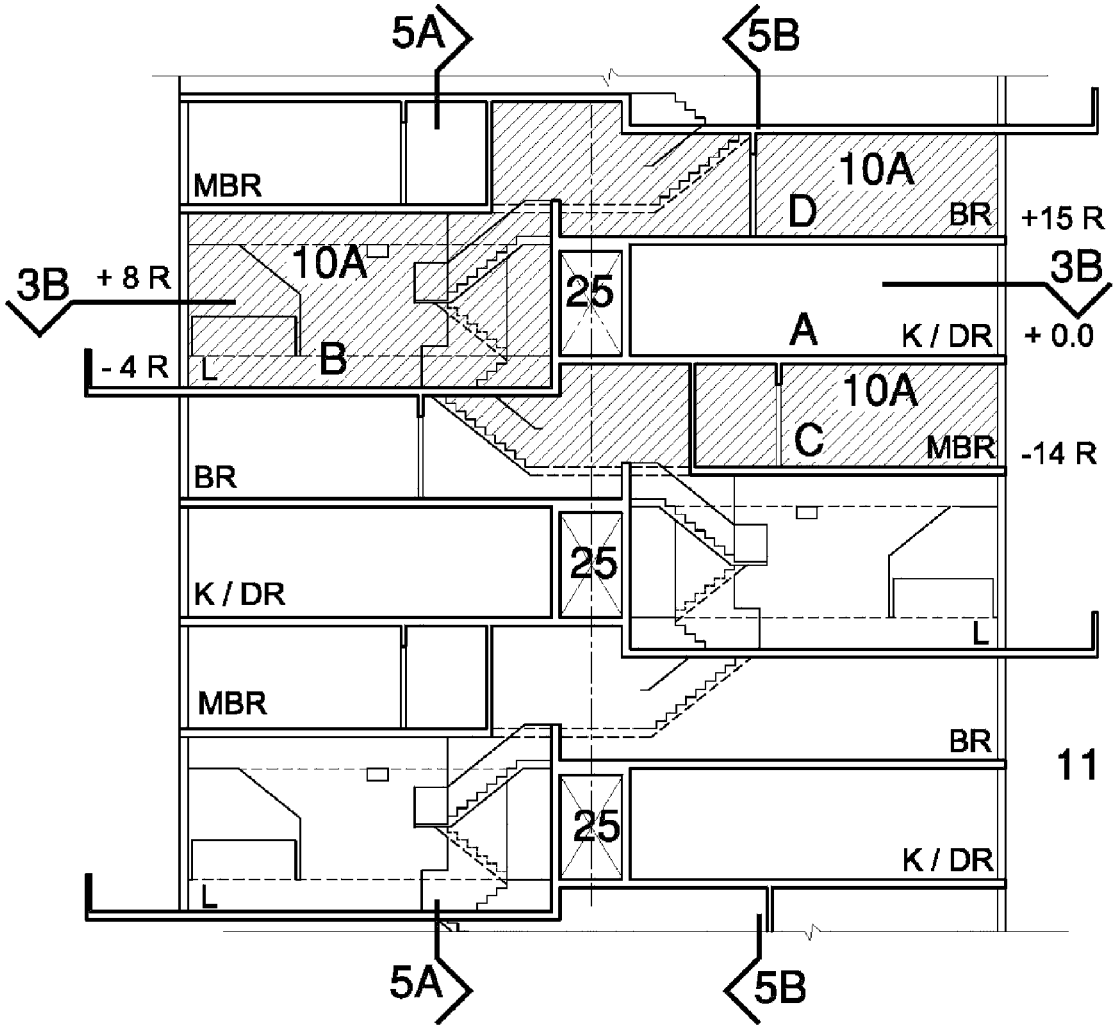
Figure 5:
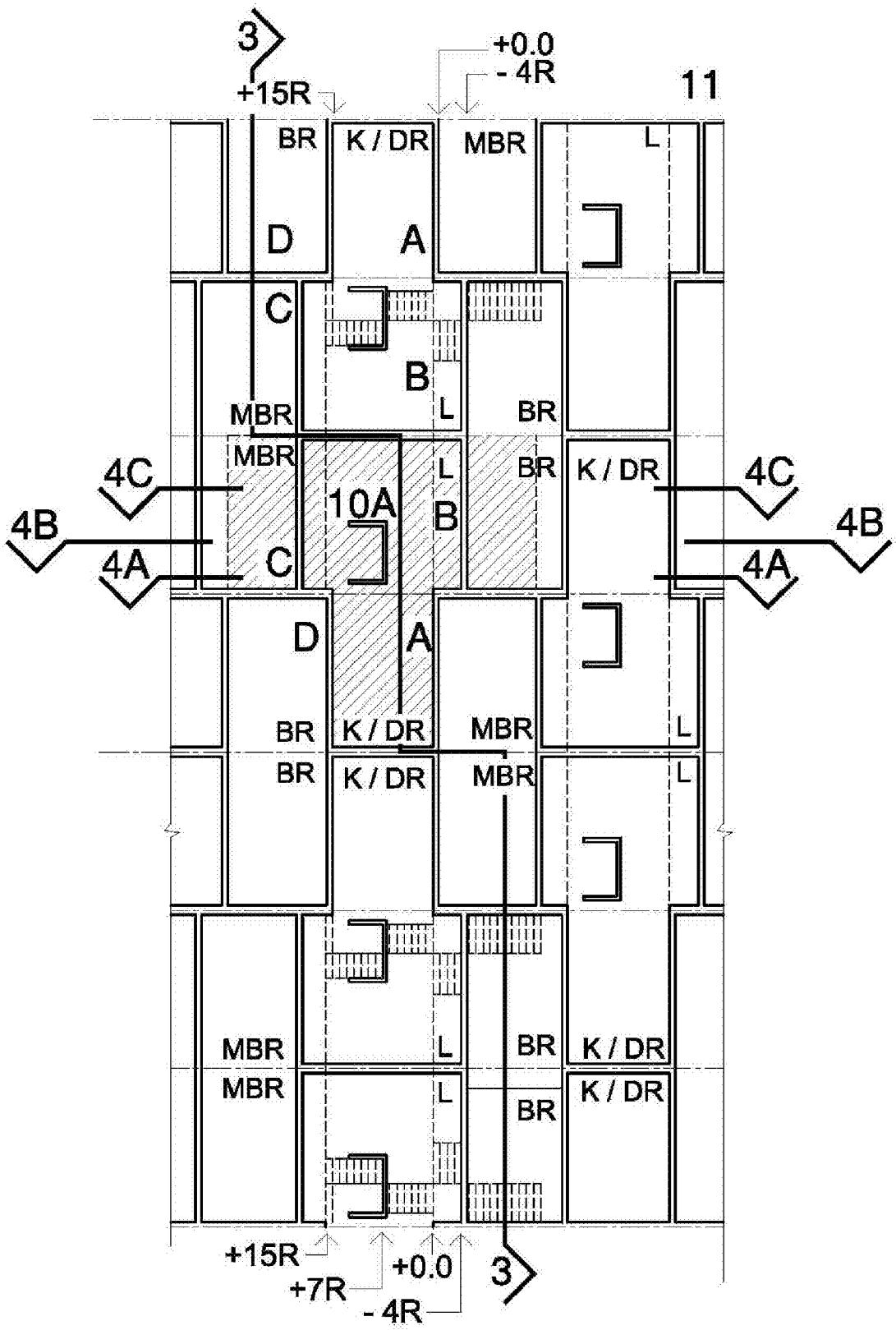
FIG. 5 is a Longitudinal Section of a portion of a building with identical apartments of a preferred embodiment taken along Section 5 as shown in FIGS. 3A, 3B, 3C, 3D, 4A, 4B, 4C. The hatched area indicates the extent of a single apartment. Stairs of a preferred embodiment are shown schematically. Partitions and certain bearing walls are omitted for clarity.
Figure 6:
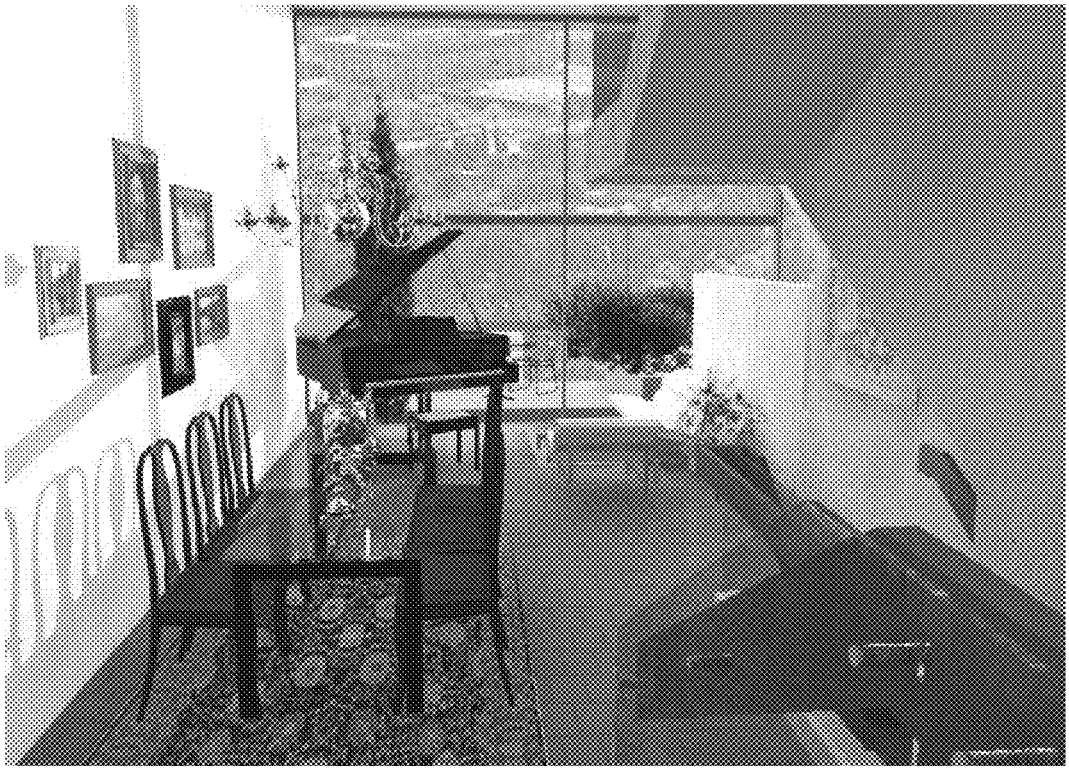
FIG. 6 is a rendered perspective view of a furnished apartment in a preferred embodiment seen from the level of the entry landing, looking across Module B toward the window and exterior balcony. A perspective line drawing of the same view is provided below the rendering for orientation.
Figure 6:
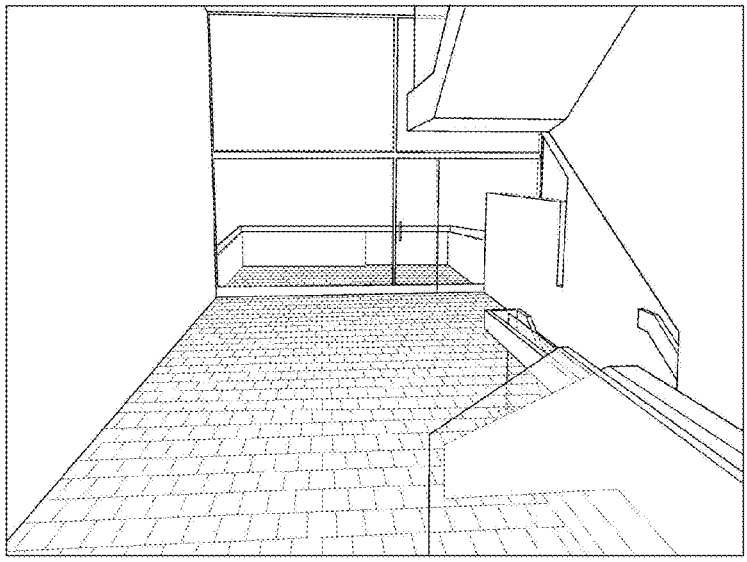
Figure 7:
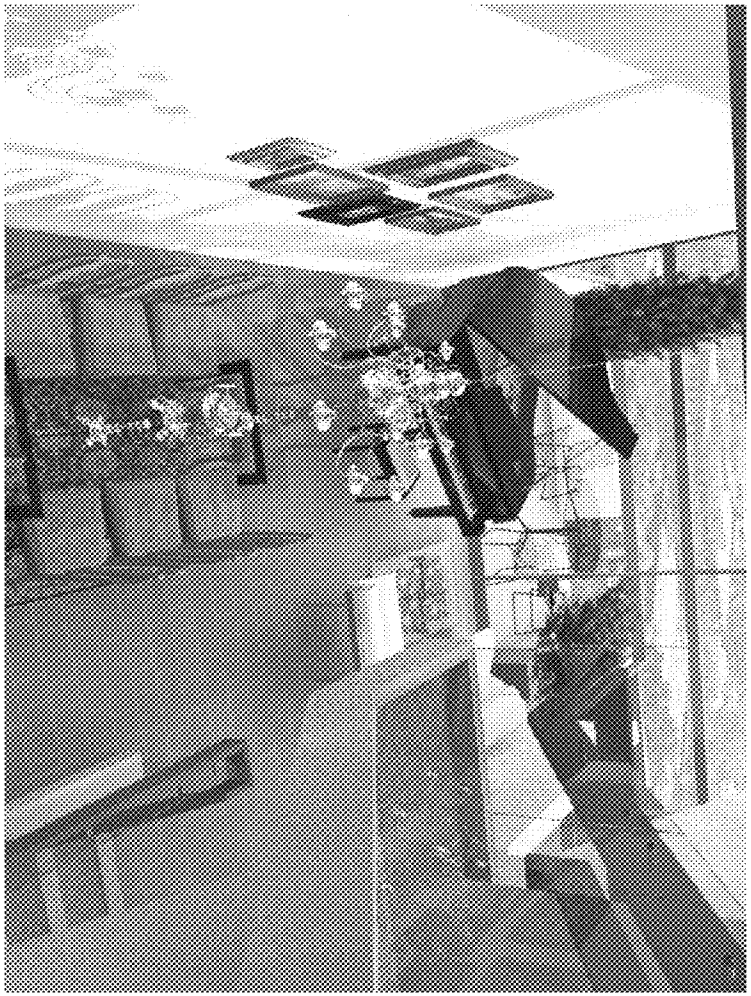
FIG. 7 is a rendered perspective view of a furnished apartment in a preferred embodiment seen from the interior balcony 69 of Module D, looking across Module B toward the window and exterior balcony. A perspective line drawing of the same view is provided below the rendering for orientation.
Figure 7:
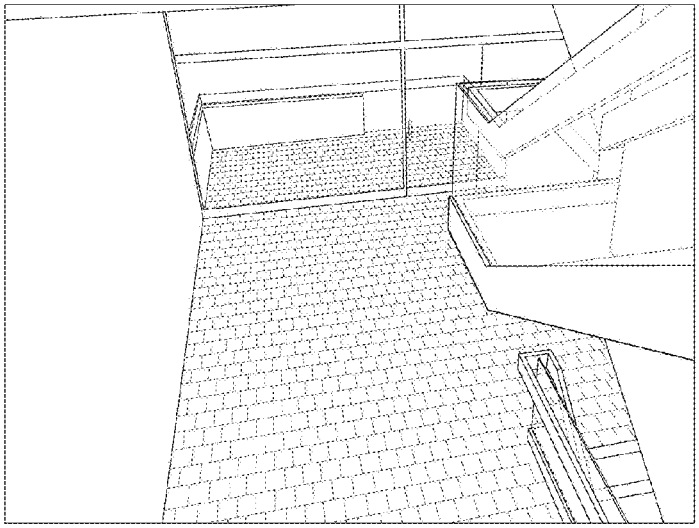
Figure 8:
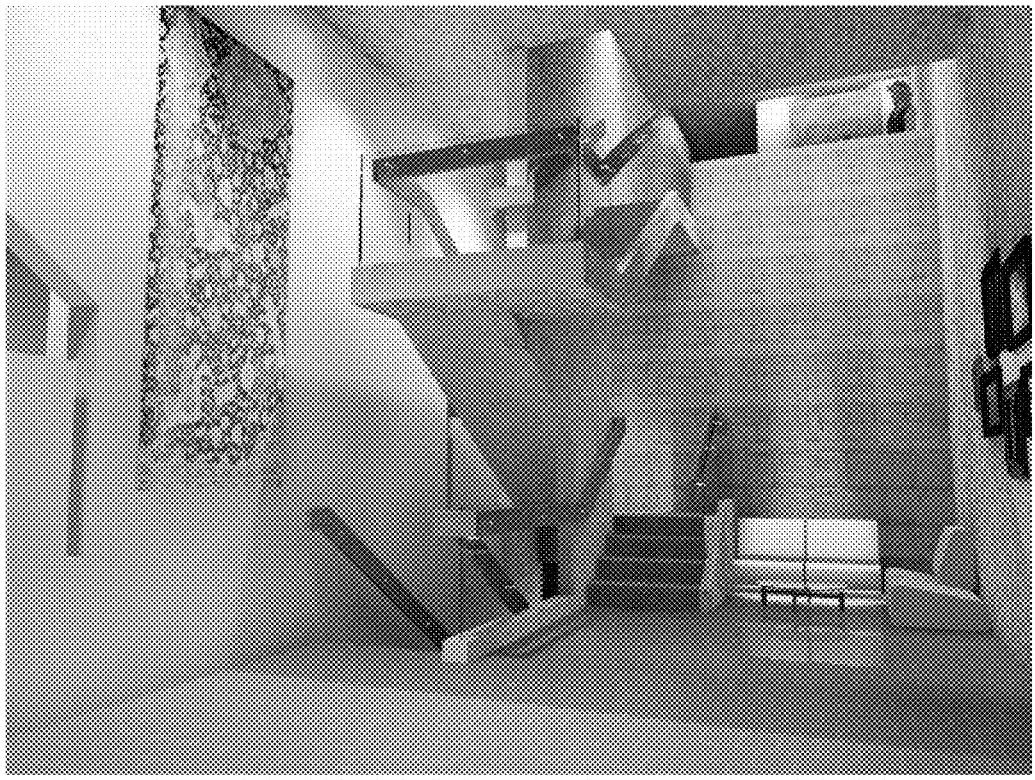
FIG. 8 is a rendered perspective view of a furnished apartment in a preferred embodiment seen from the floor 38 of Module B, looking toward the interior wall containing the apartment entry, the interior stair, and the parapet of the interior balcony. A perspective line drawing of the same view is provided below the rendering for orientation.
Figure 8:
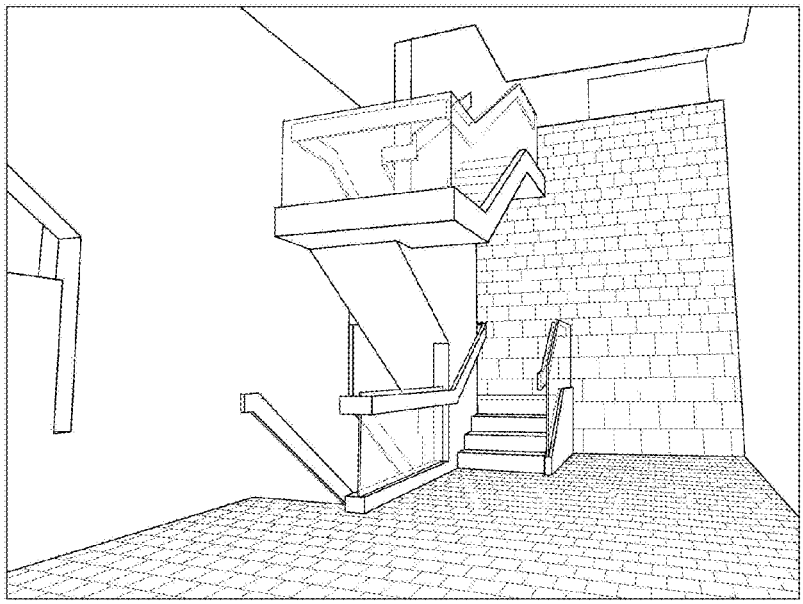

The height of Module D varies. That portion over the floor that includes the Bedroom and Toilet functions may be of minimum story height. The height over the two combined areas excised from the plane of floor 44 of Module C immediately above, may extend upward an additional story to the same ceiling plane as that of the aforementioned Module C immediately above, as shown in FIGS. 4B and 4C. A suspended ceiling may lower the ceiling plane in this location to provide interstitial space for horizontal services and recessed lighting.

The line of sight from the interior balcony of communal area 69 to the floor of Module B is controlled by the distance of the line of the atrium excision in Module C of the apartment above, measured from the parapet wall of the interior balcony of the communal area 69 of Module D.

The foregoing describes a preferred embodiment of a typical apartment unit 10A. The irregular demising envelope of this unit is complemented by an identical unit 10B rotated 180 degrees in plan about the central public corridor 25, as shown in FIG. 1. Module A of apartment 10A is thus directly across the public corridor 25 from Module B of apartment 10B. The entrance to apartment 10B, through its Module A, is thus on the opposite side of the public corridor 25 from that of apartment 10A, and diagonally opposite the Module A accessing apartment 10A.

The footprint of the resulting apartment pair is thus a rectangle, providing simplified boundaries for vertically continuous supporting walls 27 extending from one façade to the other, perpendicular to, and penetrated by the public corridor 25.

The public corridor's efficiency thus benefits from a double-loaded configuration, while its preferred centrality and vertical alignment with those of other vertical segments above and below, allows direct access to vertical shafts, chutes and service risers, minimizing non-habitable space. Structural efficiency also benefits from vertical alignment of the public corridors since building codes commonly assign higher design load standards to these than to the occupied portions of residential floors. Although the public corridor 25 may be in a schematically or nominally central location between apartments 10A and 10B, its vertical alignment with the public corridors of other segments above and below is more essential to the design. The building may be designed such that apartments on either side of the public corridor 25 vary in dimensions perpendicular to the public corridor 25.

Structural support, in a preferred embodiment, is assisted by a vertically continuous load bearing wall 71 located between Modules A and B to receive one side of the floors 32 and 38 not supported by demising walls 27. Wall 71, in a preferred embodiment, is partially open within the apartment to allow Modules A and B to communicate visually over a parapet, and to allow passage between these modules at the landing 32L, as shown in FIG. 1, or equivalent as shown in FIGS. 13A-15C, or other. The wall 71 of apartment 10A extends nominally parallel to walls 27 within the apartment, and continues across the public corridor 25 to the corresponding second apartment of the pair 10B, coplanar with wall 71 of the first apartment of the pair 10A, from one building façade to the other on the opposite side of the building.

Figures 3A, 3B, 3C, 3D:
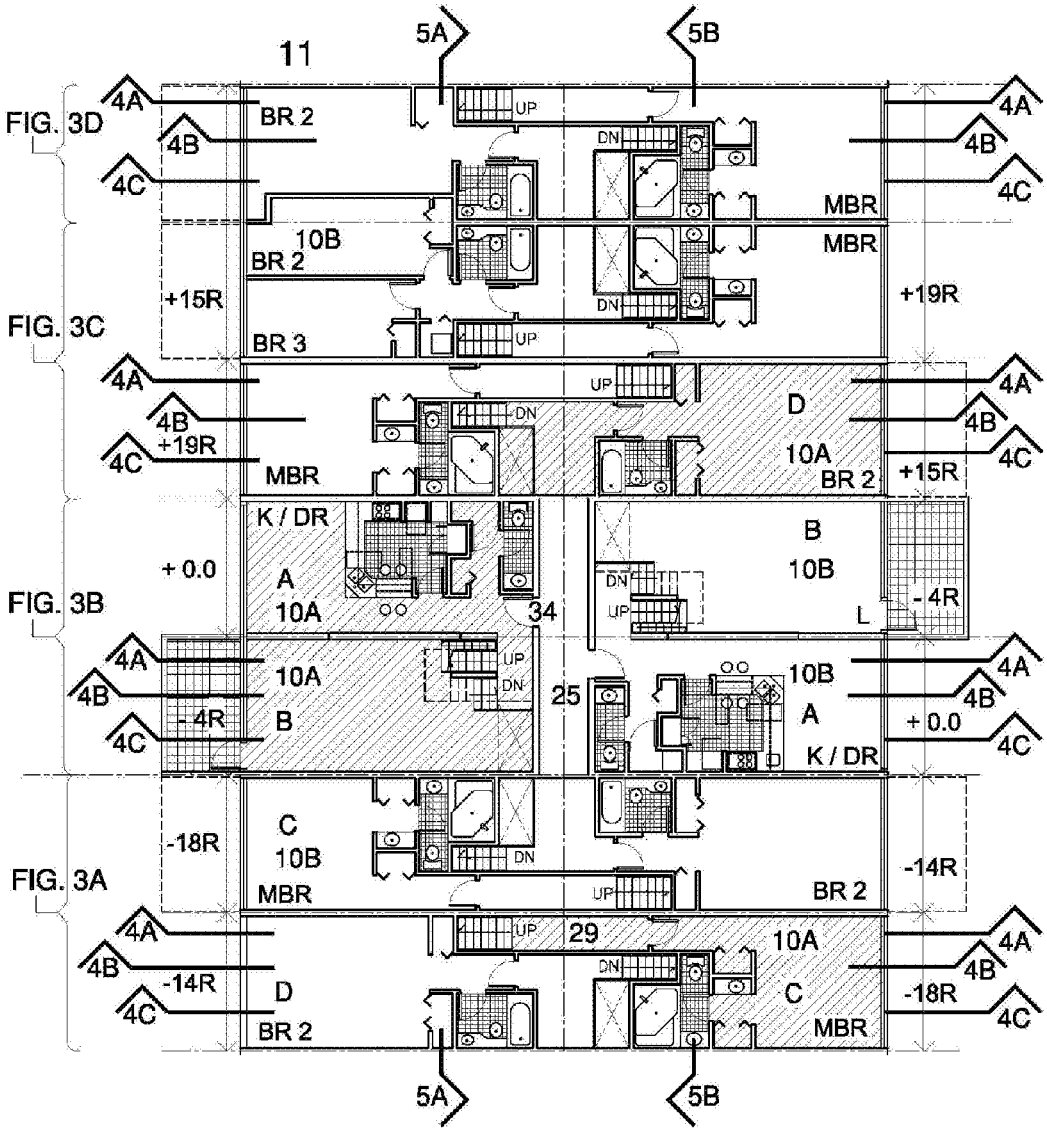
FIGS. 3A, 3B, 3C and 3D are portions of the Floor Plan of a building with identical apartments of a preferred embodiment, taken at different elevations along the stepped line of Section 3-3 shown in FIG. 5. The hatched areas distinguish separate apartments.

Apartment pairs may be added to the public corridor in mirrored juxtaposition, such that Module A of apartment 10A on one side of the corridor is adjacent to the Module A of the next apartment on the same side of the corridor, and Module B is similarly adjacent to Module B of the next apartment. The pattern is repeated on the opposite side of the public corridor 25, starting from the opposing unit, apartment 10B, as shown in FIG. 3B. The major room functions in a preferred embodiment shown in FIGS. 3A-5 are as follows: K=Kitchen, DR=Dining Room, L=Living Room, BR=Bedroom, MBR=Master Bedroom.

Apartment pairs may be stacked vertically in the same orientation to each unit as those flanking it horizontally, as described above. In this arrangement, the following juxtapositions result:

Module A of apartment 10A of the first vertical segment falls above Module C of apartment 10B of the first vertical segment, Module B of apartment 10A of the first vertical segment falls above Module D of apartment 10B of the second vertical segment, Module C of apartment 10A of the first vertical segment falls above Module B of apartment 10B of the second vertical segment, Module D of apartment 10A of the first vertical segment falls above Module A of apartment 10B of the first vertical segment.

When stacked vertically, preferably the public corridors 25 align vertically with one another. However, it is possible that the position of the public corridors 25 in stacked vertical segments may be horizontally offset from one another.

In a preferred embodiment, utilizing the interior stair support wall 12 as a utility channel, the horizontal alignments of stacked apartments provide a straight vertical path 14 through each of two such embodiment, these channels are exposed on four sides only where the stair is exposed in Module B, and concealed partly or entirely by partitions within the other modules. The stair support wall 12 of the preferred embodiment includes two major surfaces 16 and two lateral faces 20.

In a preferred embodiment, exterior balconies 40 are appended to floor 38 and/or floor 32 extending beyond the fenestration line of Module B and/or Module A. When applied to these locations, they occur at an interval of nominally five stories, as shown in FIGS. 4A, 4B, 4C. This increases the azimuth by which each balcony receives direct sunlight for the benefit of gardens, while imparting the ambience of an open terrace. The absence of shading by overhangs at the ceiling plane of the communal spaces promotes penetration of daylight into the deeper recesses of these larger spaces, as by clerestory fenestration. In the event that site orientation prohibits sunlit balconies at Modules A and B, then Module C serving the Master Bedrooms is the next most suitable level.

Figure 16:
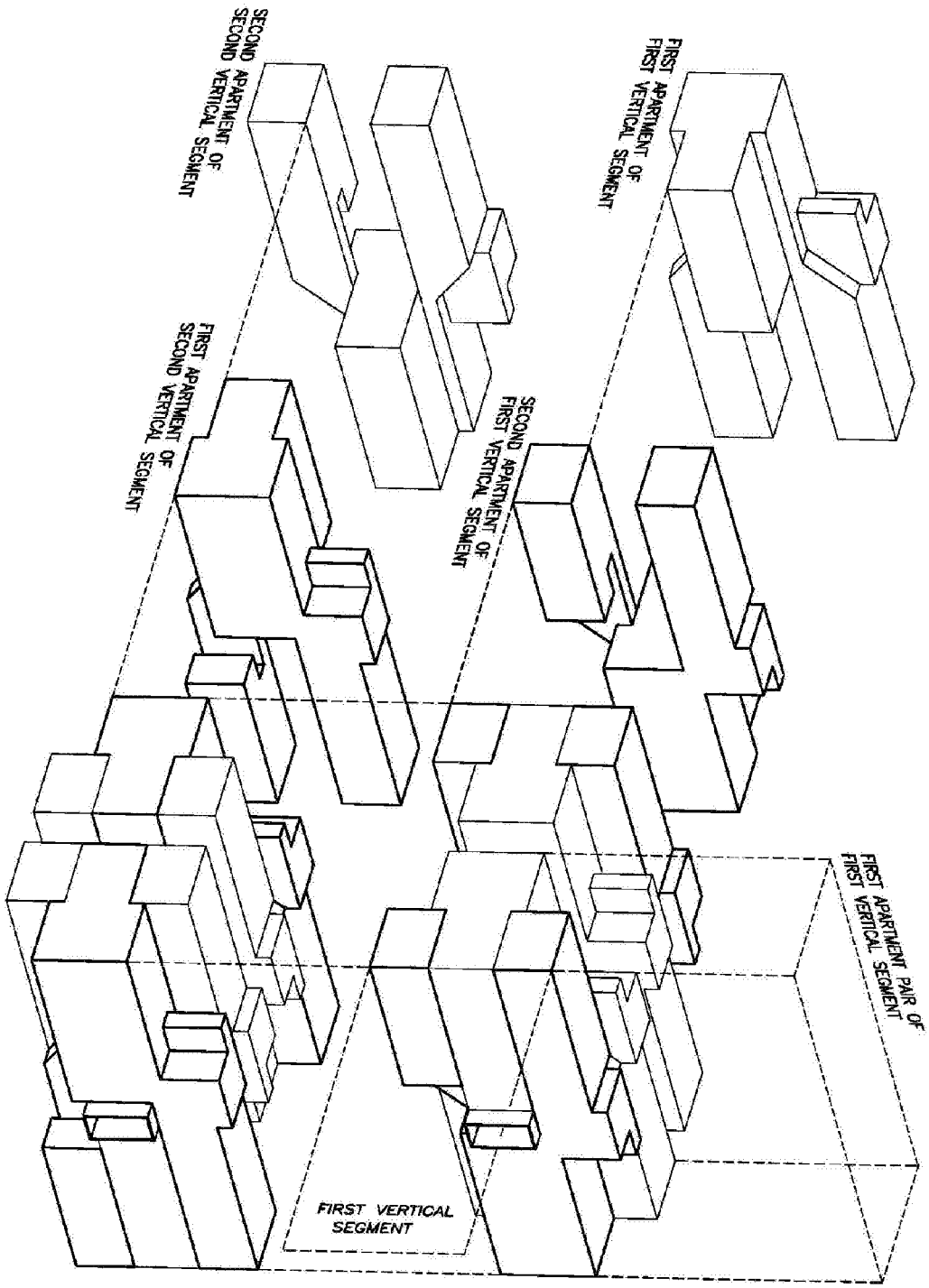
FIG. 16 is an exploded axonometric view of apartment units showing their demised envelopes diagrammatically as geometric solids. These assemble as components of a building that resolves into a rectangular solid. Structural and utility elements are omitted for clarity. The shape of the unit depicted in this view is predicated on the preferred embodiment of the internal stair design.
Figure 17:
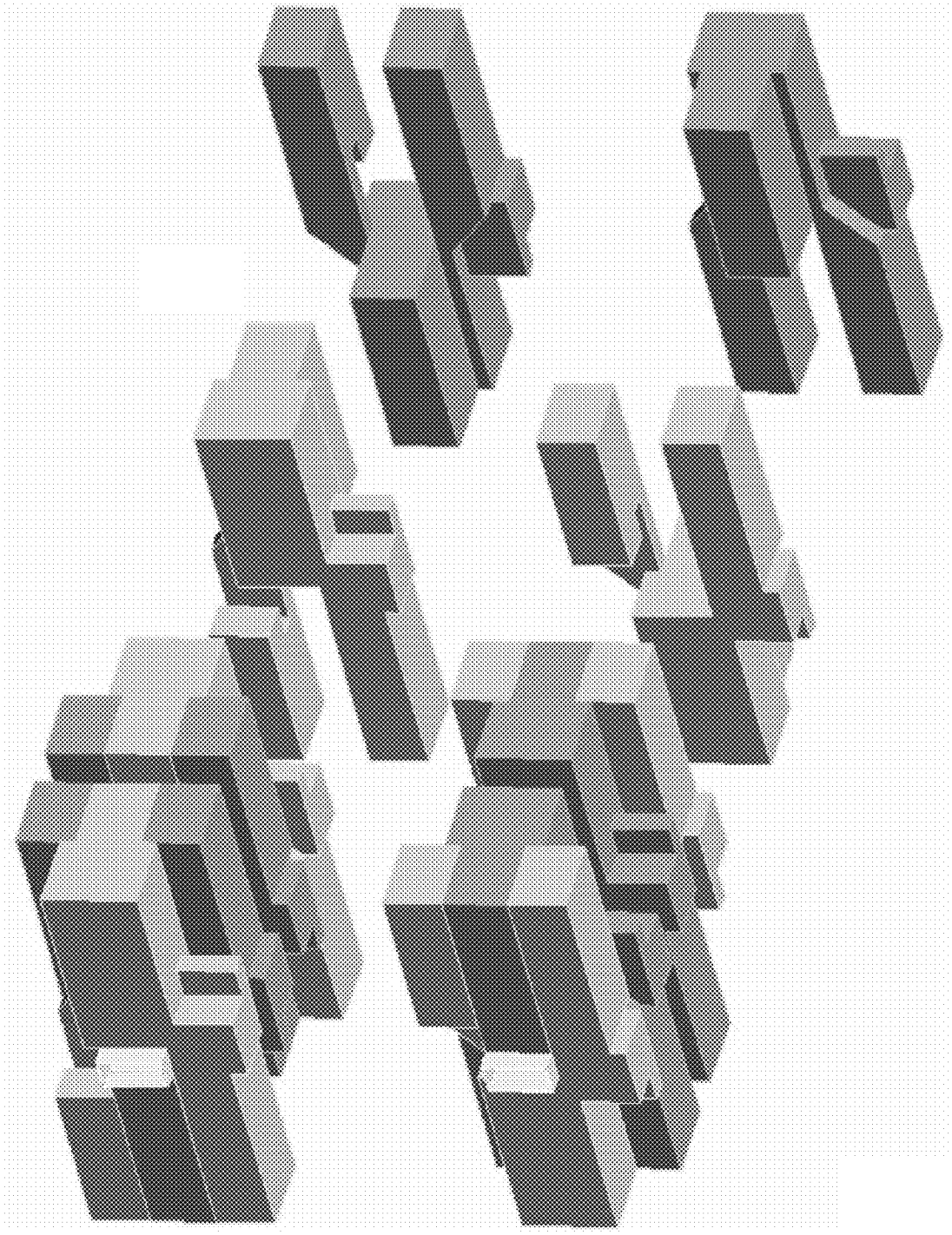
FIG. 17 is similar to FIG. 16 but seen from below wherein component units are presented as shaded geometric solids.

FIG. 16 shows an exploded view of an apartment building including several pairs of apartments 10A and 10B in each of two vertical segments arranged one on top of the other. Each pair of apartments includes apartments 10A and 10B and part of the public corridor 25 extending longitudinally alongside the apartments 10A and 10B and providing access to both apartments 10A and 10B from opposite sides of the public corridor 25. As described above, apartment 10A is rotated 180 degrees in plan in relation to apartment 10B about the public corridor 25 and each of the apartments 10A and 10B includes at least four floor levels suitable for habitation (see FIG. 1). A floor level of Module A is substantially co-planar with a floor level of the public corridor 25. Also, in each of the apartments 10A and 10B, the floor level of Module A and the floor level of Module B extend from a plane of a wall containing an entry 34 into the apartment to a building façade on a first side of the public corridor 25 on which the entry 34 from the public corridor 25 into the apartment is situated (see FIG. 3B). A floor level of Module C of each apartment 10A and 10B extends beneath the public corridor 25 to a building facade on a side of the public corridor 25 opposite to the side to which the respective modules A and B extend. The floor level of Module D of each apartment 10A and 10B extends above the public corridor 25 to the building facade on the same side of the public corridor as that to which the respective Module C extends. A stair system is arranged in each apartment 10A and 10B to connect the floor levels therein (see, for example, FIGS. 1 and 2).

Although preferred embodiments of the present invention have been described and illustrated herein, and some alternatives are cited, the universal applicability of many of its precepts make it adaptable to many circumstances. It is therefore obvious that modifications in proportions, dimensions and quantity of units, as well as partitioning and furniture will be needed to respond to requirements imposed by building codes and program objectives. Many such modifications, too numerous to describe herein, can be made without departing from the principles of the invention. For example, although the arrangement of spaces comprising an apartment unit described above is organized on basically four vertically displaced floor planes, it is conceivable to provide fewer or more floor planes, e.g., one of the floor planes may include a bi-level structure to thereby provide the apartment unit with five floor planes. This additional floor plane does not alter the fundamental novelties of the invention and thus the essence of the invention will remain the same.

The invention claimed is:

1. A multi-level building, comprising:

at least one vertical segment, each of said at least one vertical segment being comprised of at least one pair of first and second apartment units and a public corridor that provides access to said first and second apartment units, each of said first and second apartment units including at least four floor levels suitable for habitation, a first one of said floor levels being substantially co-planar with a floor level of said public corridor, said first apartment unit being rotated 180 degrees in plan in relation to said second apartment unit about said public corridor, in each of said first and second apartment units, said first floor level and a second one of said floor levels extending from a plane of a wall containing an entry into said apartment unit to a building façade on a first side of said public corridor on which the wall containing the entry from said public corridor into said apartment unit is situated, a third one of said floor levels extending beneath said public corridor to a building facade on a second side of said public corridor opposite to said first side such that said third floor level extends in a direction opposite to the direction in which said first and second floor levels extend from said public corridor, a fourth one of said floor levels extending above said public corridor to the building facade on the second side of said public corridor opposite to said first side such that said fourth floor level extends in the same direction as said third floor level extends from said public corridor; and a stair system arranged in each of said first and second apartment units to connect said at least four floor levels, wherein said first and second apartment units of said at least one apartment pair are arranged such that said first floor level of said second apartment unit is situated between said third and fourth floor levels of said first apartment unit and said first floor level of said first apartment unit is situated between said third and fourth floor levels of said second apartment unit.

2. The building of claim 1, wherein each of said first and second apartment units further includes a vertically extending wall, said stair system in each of said first and second apartment units being supported from said vertically extending wall.

3. The building of claim 2, further comprising utility conduits arranged in said vertically extending wall.

4. The building of claim 1, wherein said stair system is comprised of at least one of risers, treads, handrails, guardrails, platforms and landings.

5. The building of claim 1, wherein each of said first and second apartment units includes a structural ceiling over said first floor level, said structural ceiling providing said first floor level with a height that is substantially the same as a height of said public corridor.

6. The building of claim 5, wherein said structural ceiling provides said first floor level with a height that is greater than a minimum height of habitable space in said apartment unit to accommodate a plenum or cavity for overhead utilities and greater than minimal ostensible headroom beneath said plenum or cavity.

7. The building of claim 1, wherein said second floor level is a split-level distance, less than one-half story, below a plane of said first floor level.

8. The building of claim 7, wherein each of said first and second apartment units includes a structural ceiling over said second floor level, said structural ceiling providing said second floor level with a height that is substantially the same as:

1) a structural height of said first floor level plus twice the distance between a plane of said first floor level and a plane of said second floor level; or 2) a structural height of said first floor level plus the difference in height between a plane of said first floor level and a plane of said second floor level, plus the difference in height between a plane of said first floor level and a plane of said second floor level of another apartment unit next above said apartment unit.

9. The building of claim 1, wherein said public corridor is substantially centrally located relative to said first and second apartment units of each of said at least one pair of apartment units.

10. The building of claim 1, further comprising vertically continuous demising walls extending from one façade to the other and through all of said at least one vertical segment, said public corridor being perpendicular to and penetrating said demising walls.

11. The building of claim 10, wherein the building includes a plurality of pairs of apartment units arranged laterally adjacent to one another in a mirrored relationship about one of said demising walls for each laterally adjacent apartment pair.

12. The building of claim 10, wherein at least one of said demising walls between adjacent pairs of apartment units contains an opening leading into an apartment unit of another pair of apartment units and a corresponding projection of the demising boundary of the first pair of apartment units into said another pair of apartment units, to thereby effect a transfer of space from one apartment unit to the other.

13. The building of claim 10, wherein said demising walls provide or assist in a load-bearing or supporting function.

14. The building of claim 1, wherein in each of said first and second apartment units, said third floor level occupies a plane less than one full story beneath said second floor level, and accessed with sufficient headroom beneath said public corridor to accommodate a connecting interior stair of said stair system.

15. The building of claim 1, wherein said stair system comprises:

a stair support assembly having first and second major faces and first and second lateral faces;

a first set of risers defining a first stairway of a first vertical predetermined height and extending along said first major face of said stair support assembly and between a first landing at the level substantially co-planar with a level of said public corridor and a second landing less than one-half story below the plane of the first landing, the first and second landings are at said first and second floor levels, respectively, the first landing abutting said first lateral face of the stair support assembly and extending horizontally away from said second major face of said stair support assembly to said first floor level, the second landing abutting a second lateral face of said stair support assembly and a portion of said first major face and extending horizontally away from said first major face and second lateral face to said second floor level;

a second set of risers defining a second stairway of a second vertical predetermined height, the second set of risers extending along said second major face of said stair support assembly and between the second landing and a third landing below the plane of the second landing, the third landing being at a third level that extends horizontally away from the lowest riser of said second stairway to said third floor level;

a third set of risers defining a third stairway of a third vertical predetermined height, the third set of risers extending along said second major face of said stair support assembly and between the first landing and a platform above the plane of the first landing and within function space of said second floor level; and a fourth set of risers defining a fourth stairway of a fourth vertical predetermined height, the fourth set of risers extending along said first major face of said stair support assembly and between said platform and a fourth landing at a fourth level above the plane of said platform, said fourth set of risers extending horizontally away from said first lateral face to said fourth floor level.

16. A multi-level building, comprising:

a plurality of vertical segments, each of said vertical segments being comprised of at least one pair of first and second apartment units and a public corridor that provides access to said first and second apartment units, each of said first and second apartment units including at least four floor levels suitable for habitation, a first one of said floor levels being substantially co-planar with a floor level of said public corridor, said first apartment unit being rotated 180 degrees in plan in relation to said second apartment unit about said public corridor, in each of said first and second apartment units, said first floor level and a second one of said floor levels extending from a plane of a wall containing an entry into said apartment unit to a building façade on a first side of said public corridor on which the wall containing the entry from said public corridor into said apartment unit is situated, a third one of said floor levels extending beneath said public corridor to a building facade on a second side of said public corridor opposite to said first side such that said third floor level extends in a direction opposite to the direction in which said first and second floor levels extend from said public corridor, a fourth one of said floor levels extending above said public corridor to the building facade on the second side of said public corridor opposite to said first side such that said fourth floor level extends in the same direction as said third floor level extends from said public corridor; and a stair system arranged in each of said first and second apartment units to connect said at least four floor levels, said segments being arranged one on top of another such that the orientation of each of said apartment units on the same side of said public corridor is mirrored laterally with respect to horizontally adjacent apartment units, and vertically adjacent apartment units have the same orientation as said horizontally adjacent apartment units, which orientation is opposite that of the orientation of the subject apartment unit, wherein said first and second apartment units of each of said apartment pairs are arranged such that said first floor level of said second apartment unit is situated between said third and fourth floor levels of said first apartment unit and said first floor level of said first apartment unit is situated between said third and fourth floor levels of said second apartment unit.

17. The building of claim 16, wherein said public corridors of all of said vertical segments align vertically with one another.

* * * * *